United States Patent [19]

Sardano et al.

[11] Patent Number: 5,000,438

[45] Date of Patent: Mar. 19, 1991

[54] DOCUMENT FEEDER WITH SHEET CORNER CONTROL

[75] Inventors: Peter A. Sardano, Fairport; Jeffrey L. Andela, Sodus, both of N.Y.

[73] Assignee: Xerox Corporation, Stamford, Conn.

[21] Appl. No.: 475,496

[22] Filed: Feb. 6, 1990

[51] Int. Cl.[5] ..... B65H 5/00

[52] U.S. Cl. ..... 271/264; 271/8.1; 198/735.3

[58] Field of Search ..... 271/8.1, 121, 240, 251, 271/264, 272, 273, 278, 274, 306, 186; 355/210, 211; 354/339; 226/97, 195, 196; 198/735.3

[56] References Cited

U.S. PATENT DOCUMENTS

| | | | |
|---|---|---|---|
| 3,398,870 | 8/1968 | Mullan et al. | 226/97 |
| 3,650,620 | 3/1972 | Hoyt, III | 355/210 |
| 3,957,366 | 5/1976 | Taylor et al. | 355/3 |
| 4,579,325 | 4/1986 | Pinckney et al. | 271/186 X |
| 4,579,326 | 4/1986 | Pinckney et al. | 271/186 X |
| 4,668,072 | 5/1987 | Yasuda | 355/211 |
| 4,727,401 | 2/1988 | Partilla et al. | 355/14 |

*Primary Examiner*—H. Grant Skaggs
*Assistant Examiner*—Tuan N. Nguyen

[57] ABSTRACT

Apparatus for feeding flimsy sheets of paper or the like, particularly dog-eared or curled edge original documents a sheet corner edge guiding and flattening transverse ribs system 90, 92 is provided. The sheet feeding guide baffle surface has a plurality of spaced apart and slightly vertically extending sheet-engaging ribs 90 extending thereover, divided into two opposingly diagonal sets of plural ribs **90*a* and 90*b* on the respective sides of the sheet feeding path, extending diagonally out away from one another from the centerline of the sheet separator/feeder 80 towards the respective outer edges of their respective side of the sheet feeding path. These diagonal ribs may have their upper surfaces in a common plane but can iron out towards their respective path sides the curled or folded corners of the sheet in that side of the path. The opposing baffle surface preferably has corresponding ribs 92.**

8 Claims, 4 Drawing Sheets

DOCUMENT FEEDER WITH SHEET CORNER CONTROL

Cross-reference is made to the following copending applications by the same assignee with similar specification disclosures and filing dates: application Ser. Nos. 07/475,530, filed date Feb. 6, 1990 by Peter A. Sardano and Irvin J. Kazmierczak, and 07/475,493, filed date Feb. 6, 1990 by Peter A. Sardano and Irvin J. Kazmierczak.

The present invention relates to improved sheet feeding, with particular utility for document feeders or document handlers for sequentially feeding original document sheets, for reducing the tendency for sheet feeding jams, sheet damage or other difficulties where corners of a sheet being fed are folded, curled, or dog-eared. The disclosed system utilizes paired oppositely diagonally extending arrays of sheet engaging ribs defining the sheet guiding or baffle surfaces and ironing out the respective opposite sheet corners to their respective opposite sides of the sheet path.

Of particular interest re the present system, Taylor U.S. Pat. No. 3,957,366 notes a guide arrangement for flattening curled sheet edges.

Although document feeding is disclosed in the example herein, the present system could also be used for copy sheet feeding.

The disclosed system may desirably be integrated with various document feeders or handlers, alternatively referred to herein as an "ADF" (automatic document feeder) for convenience. The disclosed document feeder application is merely exemplary. As shown, for example, in Xerox Corporation U.S. Pat. No. 4,881,729 issued Nov. 21, 1989 or U.S. Pat. No. 4,884,794 issued Dec. 5, 1989 or U.S. Pat. No. 4,849,788 issued July 18, 1989, the present apparatus can also be used in a duplex recirculating document handler. Other current examples of retard type document feeders in which the present apparatus could be used are shown in Canon U.S. Pat. No. 4,727,398 to T. Honjo et al issued Feb. 23, 1988, U.S. Pat. No. 4,723,772 issued Feb. 9, 1988 to T. Hoji, et al, U.S. Pat. No. 4,627,709 issued Dec. 9, 1986 to T. Kitajima et al, and U.S. Pat. No. 4,544,148. Some other current examples of recirculating document handlers in general are disclosed in U.S. Pat. Nos. 4,076,408; 4,176,945; 4,278,344; 4,330,197, 4,621,801; 4,466,733; and 4,428,667.

Of further background interest re the disclosed ADF is Xerox Corporation U.S. Pat. No. 4,166,614 issued Sept. 4, 1979 to T. J. Jamlin et al. It discloses a bottom sheet document stack 24 separator/feeder 32 with a retard pad 34 engaging an area of a document feed belt 33, and normal force rollers 82 engaging the top of the stack of document sheets being so separated and fed to be copied.

The theory of retard feeders (sheet stack feeders with retard type sheet separation), especially those with shaped retard pads, is discussed at length and demonstrated with several examples in Xerox Corporation U.S. Pat. No. 3,768,803 issued Oct. 30, 1973 K. K. Stange.

By way of further background, the basic or overall ADF shown herein is also the subject of Xerox Corporation U.S. Pat. No. 4,727,401, Feb. 23, 1988 to S. R. Partilla and E. L. Dinatale. Also, a description of one example of one copier with which this ADF (or RDH) system may be suitably used is disclosed in, for example, Xerox Corporation U.S. Pat. No. 4,708,462 on Dual Mode Duplexing issued to Denis J. Stemmle.

As to specific hardware components of the subject separator/feeder apparatus, it will be appreciated that some are known per se in other apparatus or applications. For example, it is known to provide for self-tilting of the outer rubber surface or sleeve of a roller about its mounting shaft, as in U.S. Pat. No. 4,770,550 to S. Takahashi U.S. Pat. No. 4,496,145 to Fukui discloses a feed roller with a rubber surface "with a hardness at 30 to 50 degrees" in Col. 5. Retard pad references of possible background interest re their mounting include U.S. Pat. Nos. 2,085,248, 4,458,890, and 4,526,358, and French No. 2,588,537 to Saville. The latter is also noted re its nudger roll. Possible background re a nudger or normal force applying ski or the like is in U.S. Pat. No. 3,823,936, 3,869,116, 3,977,668, and 4,305,577, and Japanese 54-55971 and said French No. 2,588,536.

As xerographic and other copiers increase in speed, and become more automatic, it is increasingly important to provide higher speed yet more reliable and more automatic handling of the document sheets being copied, i.e. the input to the copier. It is desirable to reliably feed and accurately register for copying document sheets of a variety or mixture of sizes, types, weights, materials, conditions and susceptibility to damage. Yet, with this and other stack sheet feeding, it is is very desirable to provide minimal double-feeding (misseparations), misfeeding, or skewing, and minimal document jamming, wear or damage, even if the same documents are automatically fed and registered repeatedly, as for recirculating document pre-collation copying. Original document handling, particularly for delicate, valuable, thick or irregular documents, is often more difficult and critical than feeding blank or virgin sheets, particularly for documents with typing, smearable ink, fuser oil or other materials thereon susceptible of smearing or contamination of other documents by the sheet separation and feeding process. The images on documents (and/or their fusing if they are themselves copies), can change the sheet feeding characteristics and these images may be subject to damage in feeding if not properly handled, especially smearing of freshly typed typewriting ink, freshly printed ink jet printer output, etc.. Original documents can vary widely in sheet size, weight, thickness, material, condition, humidity, age, etc.. Documents may even have curls, wrinkles, tears, "dog-ears", cutouts, overlays, tape, paste-ups, punched holes, staples, adhesive, or slippery areas, or other irregularities. Unlike copy sheets, which generally are from the same new clean batches and therefore of the same general condition and size, documents can often vary considerably even if they are all of the same "standard" size, (e.g. letter size, legal size, A-4, B-4, etc.). Documents, even in the same document set, may have come from different paper batches or have variably changed size with different age or humidity conditions, different imaging, etc..

Avoidance of sheet skewing during feeding and maintaining proper registration and feed timing of documents is also important. If the document is not properly fed to and registered on the platen, then undesirable dark borders and/or edge shadow images may appear on the ensuing copy sheet, or information near an edge of the document may be lost, i.e. not copied onto the copy sheet. Document misregistration, especially skewing, can also adversely affect further feeding, ejection, and/or restacking of the documents.

In the description herein the term "document" or "sheet" refers to a usually flimsy sheet of paper, plastic, or other such conventional individual image substrate. The "document" is the sheet (original or previous copy) being copied in the copier onto the "copy sheet", which may be abbreviated as the "copy". Related, e.g. page order, plural sheets of documents or copies are referred to as a "set". A "simplex" document or copy sheet is one having its image and page number on only one side or face of the sheet, whereas a "duplex" document or copy sheet has "pages", and normally images, on both sides.

A specific features disclosed herein is to provide, in a sheet feeding apparatus for feeding flimsy sheets of paper or the like in a sheet feeding direction through a sheet feeding path thereof, said sheet feeding path including opposing spaced apart sheet feeding guide baffles, and said sheets having two opposing corners feeding through the two opposite sides of said sheet feeding path, the improvement in reducing feeding difficulties where some such sheet corners have dog-eared or curled edges, wherein: at least one of said sheet feeding guide baffles having a first plurality of first diagonal sheet engaging ribs in one side of said sheet feeding path, said first plurality of first diagonal sheet engaging ribs extending diagonally in said sheet feeding direction and also extending diagonally out towards said one side of said sheet feeding path, for ironing out towards said one side said dogears or curls in the corner of a sheet in said one side of said sheet feeding path, and at least one of said sheet feeding guide baffles having a second plurality of second diagonal sheet engaging ribs in the other side of said sheet feeding path, said second plurality of second diagonal sheet engaging ribs extending diagonally in said sheet feeding direction and also extending diagonally out towards said other side of said sheet feeding path, for ironing out towards said other side said dogears or curls in the corner of a sheet in said one side of said sheet feeding path.

Further features which may be provided by the system disclosed herein, individually or in combination, include those wherein said sheet feeding path includes a generally intermediately located document sheet separator/feeder generally intermediately of said first and second plurality of first and second diagonal sheet engaging ribs and wherein both said sheet feeding guide baffles have respective said first and second pluralities of first and second diagonal sheet engaging ribs thereon, in corresponding diagonalites, and/or wherein said first and second plurality of first and second diagonal sheet engaging ribs extends over at least a major portion of said sheet feeding guide baffle so that said sheets in said sheet feeding path remain under the influence of said ribs through said sheet feeding path, and/or wherein said document sheet separator/feeder engages said sheets in substantially the same plane as said sheet engaging ribs on one of said sheet feeding guide baffles, and/or wherein one of said sheet feeding guide baffles is pivotally openable relative to the other sheet feeding guide baffle, and/or wherein the other said sheet feeding guide baffle has respective said first and second pluralities of first and second diagonal sheet engaging ribs thereon, in corresponding diagonalites, but at least some of said ribs thereon have substantially greater height and are interrupted in the area of said document sheet separator/feeder and said document sheet separator/feeder extends therebetween.

All references cited in this specification, and their references, are incorporated by reference herein where appropriate for appropriate teachings of additional or alternative details, features, and/or technical background.

Various of the above-mentioned and further features and advantages of the invention will be apparent from the apparatus and its operation described in the specific example below. Thus, the present invention will be better understood from the following description of this exemplary embodiment thereof, including the drawing figures (approximately to scale) wherein.

Figure 3:
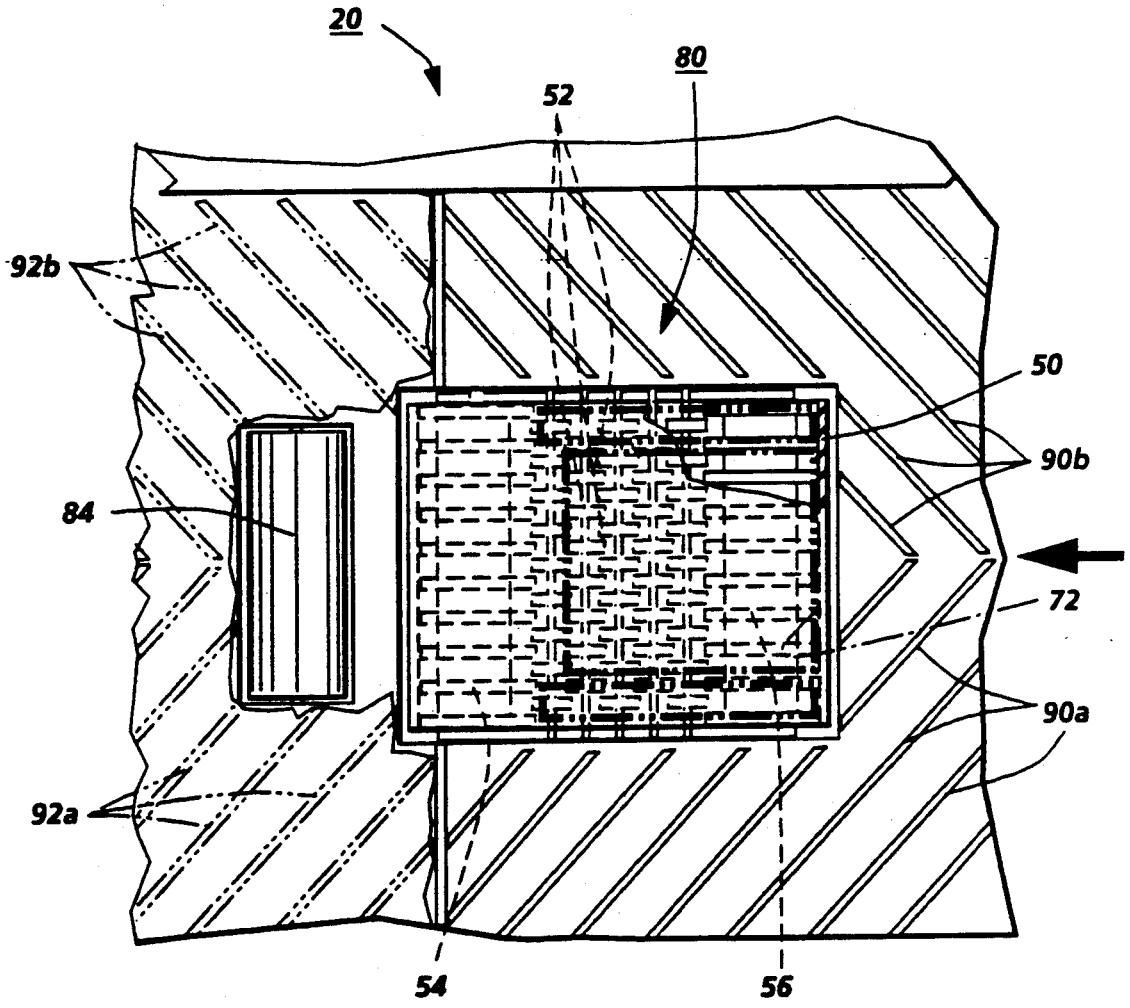
FIG. 3 is a partial top view of the separator/feeder of FIG. 2 taken along the line 3—3 of FIG. 2 but also showing in phantom thereover the engagement area of the normal force or stack hold-down ski.
Figure 4:
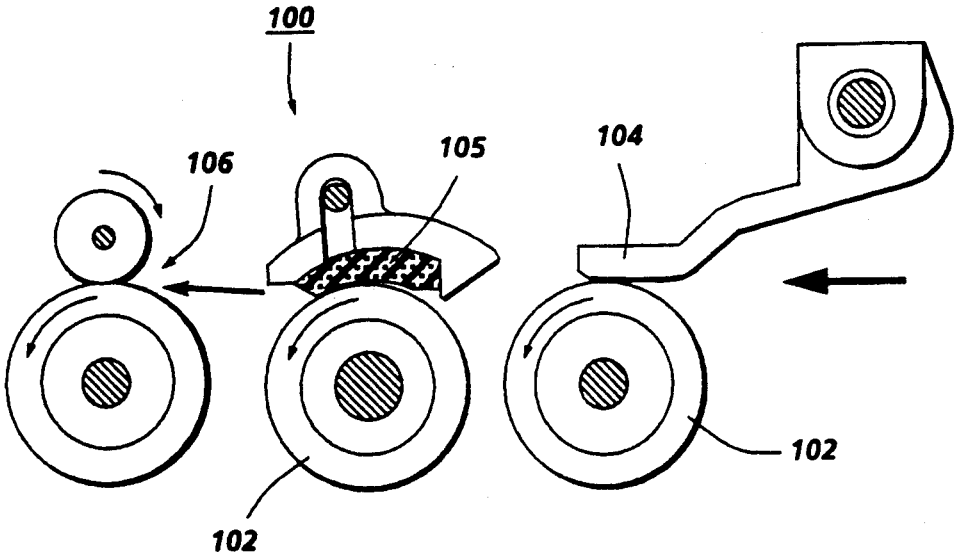
FIG. 4 PRIOR ART
Figure 5:
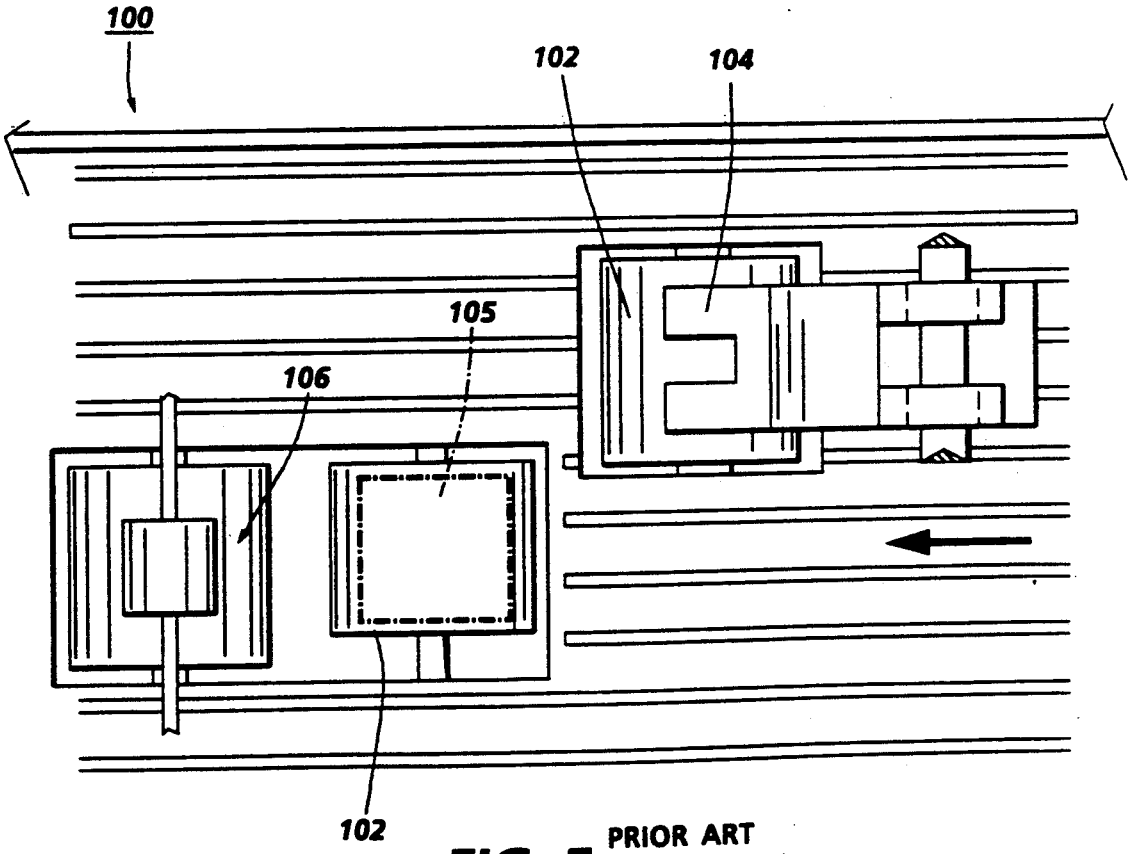
FIG. 5 PRIOR ART

and FIGS. 4 and 5 are schematic side and top views of the prior art Xerox Corporation "5028" Copier; Details of one exemplary sheet feeder/separator apparatus 80 in accordance with the invention are shown in one application being used in an ADF 20 for document feeding in FIG. 1, and shown per se, enlarged, in FIGS. 2 and 3. It will be appreciated with the sheet feeder/-separator 80 may be utilized with various other document handlers or other applications, and/or with almost any copier, including various of those cited herein. Thus the only portion of an exemplary copier 10 illustrated here is the copier platen 12 shown in FIG. 1.

Figure 1:
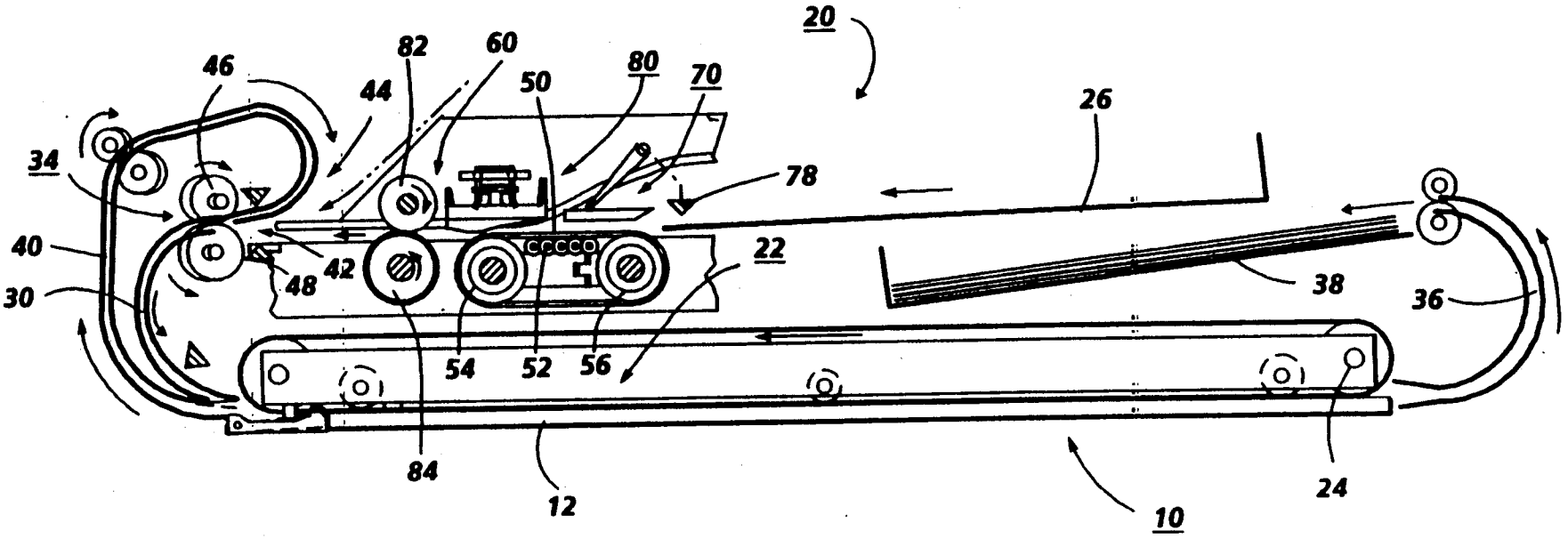
FIG. 1 is a partly schematic side view of an exemplary document handler incorporating one example of sheet feeder apparatus in accordance with the present invention.

The exemplary overall ADF 20 here disclosed in FIG. 1 is otherwise like that of the above-cited U.S. Pat. No. 4,881,729 or 4,884,794 or 4,849,788, and thus not be redescribed here. Documents sheets to be copied by the copier 10 from a document stack are separated and sequentially fed towards the platen 12 by the ADF 20. The document is then driven over the platen 12 surface into a desired copying registration position by the platen belt transport system 22, with its drive 24. The document is then ejected by the platen transport 22 from the platen 12 after it is copied.

The set or stack of original documents to be fed and copied may be initially loaded stacked face-up into the document tray 26. They are sequentially fed out from the bottom of the stack by the sheet separator/feeder 80 (to be further described). All document sheets are initially fed downstream through a simplex path 30 to the acquisition entrance to the belt transport system 22, adjacent the platen 12. The initial portion of this simplex path 30, (just downstream of the separator/feeder 80) includes a side edge registration and deskewing system 34. This system 34 may be a known crossed-rolls 46, 48 and edge guide system.

The ADF unit 20 may be utilized as a non-recirculating automatic document feeder by not returning the documents to the tray 26 after copying. After copying, documents may be ejected, as shown, from the opposite, downstream, end of the platen into an output inverting path 36 which inverts the documents and ejects them up into an output restacking tray 38.

If the documents are duplex documents requiring inversion, they may be inverted in a duplex path 40. The duplex path 40 here is a continuous unidirectional loop which starts and ends at the same side of the platen. The duplex path 40 here smoothly merges into the simplex path 30 at a path intersection 42 upstream of the edge registration and deskewing 42 system 34 but downstream of the separator/feeder 80. At this intersection 42 each duplex document has been turned over twice from its orientation coming off the platen, and is feeding in the downstream direction into the simplex path 30, i.e., in the same feeding direction as a document being initially fed from the tray 26, as shown by the arrows in FIG. 1 An alternate single sheet bypass input 44 may also be provided there, as shown by the illustrated dot-dash arrow. All three said paths 30, 40, 44 are entering the same side edge registration and deskewing system 34, and may also use the same sheet lead edge sensor, shown there schematically as a diamond or arrowhead shape.

Conventionally, additionally connected to the copier controller are additional document sheet lead and/or trail edge sensors strategically positioned around the document path, including a stack input sensor 78.

Describing now in further detail the specific example illustrated in the Figures of the separator/feeder 80, there is schematically shown therein a retard type sheet separator/feeder in which the bottom of the stack of sheets is engaged and driven downstream to a nip with a retard pad 62, for separation and feeding of only the bottom sheet, by the generally planer upper flight of a driven frictional separator feed belt 50.

That feeding by the moving belt 50 is assisted by a normal force applying ski or shoe unit 70. The unit 70 is actuated by sensor after the document stack is inserted to pivotally lower arm assembly 76 with a ski or shoe 72 pivotally 74 mounted to the end thereof. The ski 72 thereby rides on the top of the stack over the belt 50 with a preset downward normal force pressing the stack down against the belt 50 under the ski 72. The relatively large area and location of this ski 72 normal force engagement is shown from above in phantom in FIG. 3, and from the side in FIG. 2. The bottom of the ski 72 is planar and of relatively low friction material to allow the stack to slide thereunder. The freely pivotal intermediate mounting 74 thereof allows the downward normal force to be applied via the arm 76, yet be applied uniformly to the documents by allowing the free self-pivoting of the bottom surface of the ski 72 into alignment with the plane of the top of the stack, which is only indirectly controlled by the belt 50 mounting and lower sheet guide surface (ribs) 90. Thus the normal force is distributed evenly over a relatively large area of the documents, and high pressure points which could cause smearing of document images are reduced. What is also provided here is a freely dual axis gimbaled mounting 74 of the ski 72 which allows the ski to adjust to various different stack heights, and maintain adequate total normal force while preventing high pressure points or concentrations which could cause smearing with a large ski area of contact, and to evenly applied low pressure thereover. This may be provided at 74 by a rotatable pin connection on one axis to allow pivoting with lose (oversize) pin holes or straps to also allow a substantial free tilt range on the other, orthogonal, axis. Other alternatives, such a snap fit ball and socket connection, may be used.

Figure 2:
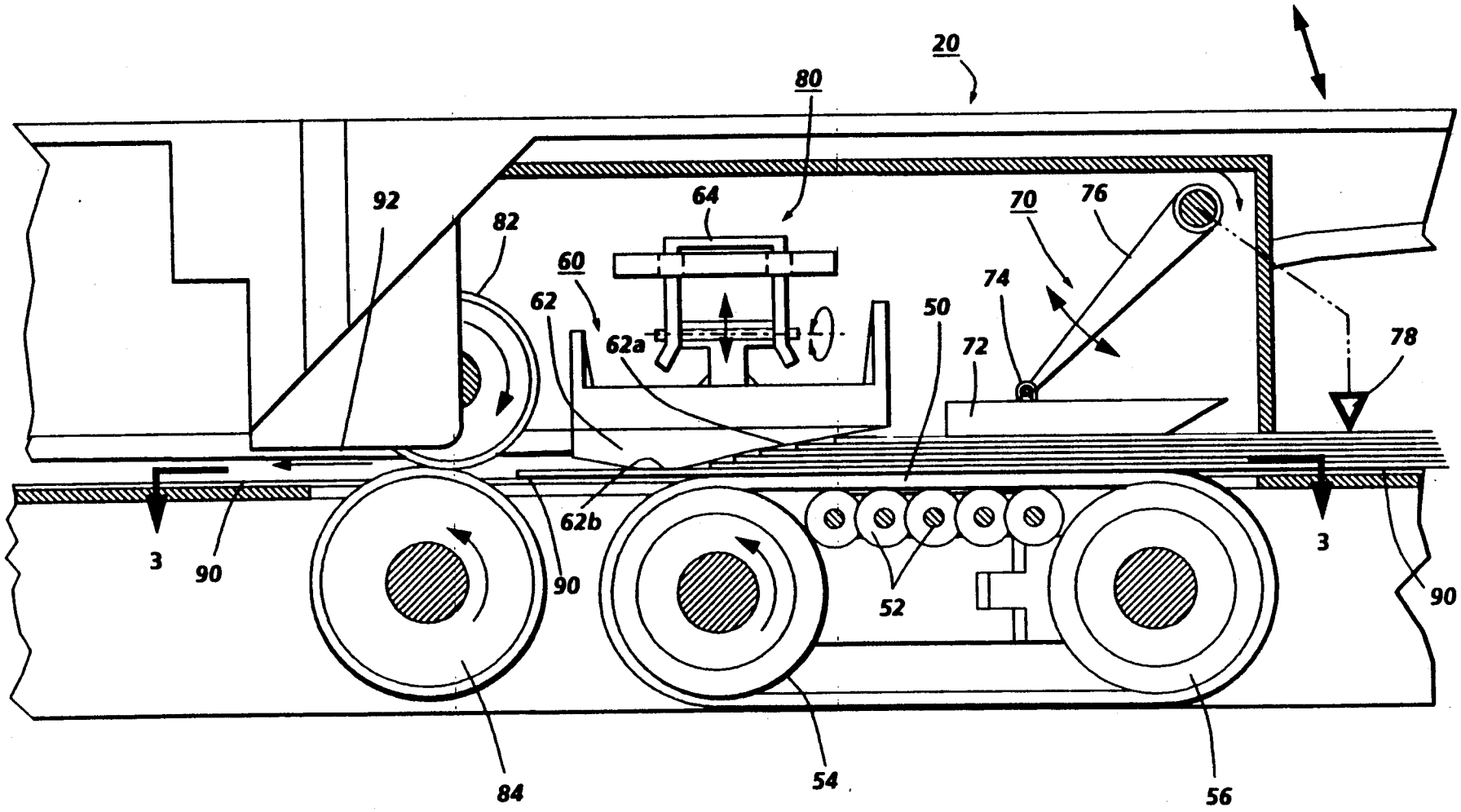
FIG. 2 is an enlarged cross-sectional side view of the separator/feeder of the ADF of FIG. 1. For illustration clarity a relatively small plurality of sheets is shown being separated, and illustrated here with exaggerated sheet thickness.

The elastomeric frictional retard pad 62 is part of a special retard pad mounting assembly 60, wherein the retard pad 62 is linearly vertically movable up and down (perpendicular the sheet path), as shown by the large linear double headed arrow in FIG. 2, on an inverted "U" channel or other suitable pad holding clip 64, which is vertically (only) movable through corresponding apertures or guide slots in a fixed frame mounting plate, as shown in FIG. 2. Thus, the clip 64 cannot rotate or tilt. The pad 62 may be spring loaded down with a desired nip force toward a sheet separation nip adjacent the downstream end of the belt 50 upper flight. This illustrated retard pad mounting assembly 60 also provides for relatively unrestricted lateral or transverse pivoting of the retard pad 62 for its self-leveling and nip force uniformity in that axis, across the belt 50, as shown by the smaller circular double header arrow shown about the illustrated pivot pin axis mating with the clip 64. However, movement or rotation of the retard pad 62 on the orthogonal axis (the sheet path direction) is prevented by this mounting 60. This maintains the retard path 62 in the correct position and maintains constant the illustrated small angle of the upstream lower surface **62*a* of the retard pad 62 which provides the initial stack separation entrance and resists which is called "slug feeding" of plural sheets into the final retard nip, defined here by the small lowermost flat area 62*b* of the retard pad 62. By thus preventing any pivoting or other movement of the retard pad in the sheet feeding direction, there is also decreased sensitivity to the positioning of the retard pad relative to the feed belt 50 (or to a feed roller, if one is used instead). Smudging may also be reduced. Also, "slip-stick" type noise generation might be reduced. This low cost and simple mounting assembly 60 may be made from molded plastic parts such as a polycarbonate, with 30% glass fibers. No lubrication is required. As shown, the retard pad 62 operative lower surface is generally convex, with a small angle, preferably less than 15 degrees, generally planar stack shingling entrance wedge formed by the upstream lower surface 62*a*, narrowing up to the apex at 62*b*, and then preferably a larger exit clearance angle after this primary retard area 62*b***.

After a bottom sheet has been so separation from the rest of the stack, it is fed on downstream into the nip of take-away drive roller 82, and take-away idler roller 84, which feeds the document sheet on towards the platen. To resist skew inducement in the take-away nip, the take-away idler roller 84 here is preferably a solid plastic or metal cylinder coated with a 1 mm sleeve of urethane having a 45 Shore A durometer. With this surface self-leveling, the idler 84 does not have to be axially pivotally mounted to be self-leveling on the take-away drive roller 82 nip surface. The idler 84 can be a simple (but coated as described) apertured solid delrin sleeve rotating on a fixed axis solid metal shaft. The take-away drive roller 82 may be a solid metal cylinder coated with a 2 mm sleeve of isoprene or other suitable elastomer.

Also disclosed is a special system for maintaining the elastomeric frictional separator feed belt 50 flat and positively supporting the belt flight before and through its engagement with the retard pad 62. A plurality of 5 common small diameter closely spaced idlers 52 are provided by multiple disks on small shafts are all mounted in one plane behind the belt 50 to simulate a flat backing plate, but without the frictional drag of a flat plate under a frictional belt. They provide rolling contact with the belt. The shafts for the discs 52 may be additionally center supported to resist deflection. The adjacent said idlers 52 are slightly transversely offset to be interdigitated and thus provide and even closer pattern of supporting planar contact points under the belt, i.e., minimum center to center distances, yet not transitioning irregularities. Similarly thin and interdigitating but larger diameter plural idler disks are provided as part of the end and driving rollers 54 and 56, respectively, as shown in phantom in the top view of FIG. 3. All these components may be a low cost plastic parts assembly, around which the belt 50 is tensioned by its assembly therein. This belt mounting system helps reduce image or second side smudge in this friction-retard feeder. A truly flat and fully continuous belt backing surface would not be as desirable or contact-maintainable as the multiplicity of supporting points provided here. While the general concept of plural belt backing rollers is used in many large platen transport belts document handlers and other large belt feeders, per se, it provides particular advantages in this system and application.

Turning now to the subject feature of the illustrated separator/feeder 80 there is disclosed a sheet corner edge guiding and flattening transverse ribs system 90, 92, particularly visible in FIG. 3. This may be used in various other apparatus for feeding flimsy sheets of paper or the like in a sheet feeding direction through a sheet feeding path. Such sheet feeding paths normally include, as here, opposing spaced apart sheet feeding guide baffles, usually flat or with ribs extending in the sheet movement direction. Particularly where there is a relatively large spacing between opposing baffle surfaces, and dog-eared or curled up edge documents need to be fed without damage. The disclosed system 90, 92 utilizes the fact that a sheet will have its two opposing edge corners feeding through the two opposite sides of said sheet feeding path. The system here reduces feeding difficulties where some such sheet corners have dog-eared or curled up edges, as is often the case with original documents.

The lower sheet feeding guide baffle surface here has a plurality of spaced apart and slightly vertically extending sheet engaging ribs 90. The sheet normally freely slides over these ribs 90, and the ribs 90 preferably extend over substantially the entire feeding baffle area except for the small area where the sheet is being engaged by the separator/feeder 80 and the take-away rollers so as to have influence over the sheet during the full entrance into the ADF 20. The small rib height and relatively close rib spacing is such that no sheet lead edge corner will ever be in a stubbing condition with any rib. These ribs 90 are preferably linear, as shown, but as shown they are divided into two opposingly diagonal sets of plural ribs 90*a* and 90*b* on the respective opposite sides of the sheet feeding path, merging and extending diagonally out from the centerline of the sheet feeding path and the separator/feeder 80. The first plurality of first diagonal sheet engaging ribs 90*a* extend diagonally in said sheet feeding direction but also extending diagonally out towards the edge of their respective side of the sheet feeding path. Thus these diagonal ribs can iron out towards that one side the downward or upward dog-ears or curls in the corner of the sheet in that side of the sheet feeding path. Likewise, the opposite sheet corner, if it is curled, can be engaged by the oppositely diagonal second plurality of sheet engaging ribs 90*b* in the other side of the sheet feeding path, extending diagonally out towards the outside of that other side of said sheet feeding path, for ironing out towards that other side any dog-ears or curls in that corner of the sheet in that other side of the sheet feeding path. The document sheet separator/feeder 80 preferably engages sheets in substantially the same plane as the plane defined by the upper surfaces of the sheet engaging ribs 90.

The upper baffle surface here has corresponding ribs 92, in two correspondingly diagonal sets 92*a* and 92*b*. At least some of the ribs 92 have substantially greater height and are interrupted in the area of the document sheet separator/feeder 80 to allow the document sheet separator/feeder 80 to extends therebetween. This upper sheet feeding guide baffle is preferably pivotally openable relative to the other sheet feeding guide baffle.

While the embodiment disclosed herein is preferred, it will be appreciated from this teaching that various alternatives, modifications, variations or improvements therein may be made by those skilled in the art, which are intended to be encompassed by the following claims:

We claim:

1. In a sheet feeding apparatus for feeding flimsy sheets of paper or the like in a sheet feeding direction through a sheet feeding path thereof, said sheet feeding path including opposing spaced apart sheet feeding guide baffles, and said sheets having two opposing corners feeding through the two opposite sides of said sheet feeding path, the improvement in reducing feeding difficulties where some such sheet corners have dog-eared or curled edges, wherein:

at least one of said sheet feeding guide baffles having a first plurality of first diagonal sheet engaging ribs in one side of said sheet feeding path, said first plurality of first diagonal sheet engaging ribs extending diagonally in said sheet feeding direction and also extending diagonally out towards said one side of said sheet feeding path, for ironing out towards said one side said dogears or curls in the corner of a sheet in said one side of said sheet feeding path, and at least one of said sheet feeding guide baffles having a second plurality of second diagonal sheet engaging ribs in the other side of said sheet feeding path, said second plurality of second diagonal sheet engaging ribs extending diagonally in said sheet feeding direction and also extending diagonally out towards said other side of said sheet feeding path, for ironing out towards said other side said dogears or curls in the corner of a sheet in said one side of said sheet feeding path.

2. The sheet feeding apparatus of claim 1, wherein said sheet feeding path includes a generally intermediately located document sheet separator/feeder generally intermediately of said first and second plurality of first and second diagonal sheet engaging ribs.

3. The sheet feeding apparatus of claim 1, wherein both said sheet feeding guide baffles have respective said first and second pluralities of first and second diagonal sheet engaging ribs thereon, in corresponding diagonalites.

4. The sheet feeding apparatus of claim 1, wherein said first and second plurality of first and second diagonal sheet engaging ribs extends over at least a major portion of said sheet feeding guide baffle so that said sheets in said sheet feeding path remain under the influence of said ribs through said sheet feeding path.

5. The sheet feeding apparatus of claim 2, wherein said first and second plurality of first and second diagonal sheet engaging ribs extends over at least a major portion of said sheet feeding guide baffle so that said sheets in said sheet feeding path remain under the influence of said ribs through said sheet feeding path.

6. The sheet feeding apparatus of claim 2, wherein said document sheet separator/feeder engages said sheets in substantially the same plane as said sheet engaging ribs on one of said sheet feeding guide baffles.

7. The sheet feeding apparatus of claim 3, wherein one of said sheet feeding guide baffles is pivotally openable relative to the other sheet feeding guide baffle.

8. The sheet baffle apparatus of claim 6, wherein the other said sheet feeding guide baffle has respective said first and second pluralities of first and second diagonal sheet engaging ribs thereon, in corresponding diagonalites, but at least some of said ribs thereon have substantially greater height and are interrupted in the area of said document sheet separator/feeder and said document sheet separator/feeder extends therebetween, and wherein said first and second plurality of first and second diagonal sheet engaging ribs extends over at least a major portion of said sheet feeding guide baffle so that said sheets in said sheet feeding path remain under the influence of said ribs through said sheet feeding path except in said area of said document sheet separator/-feeder.

* * * * *

UNITED STATES PATENT AND TRADEMARK OFFICE

CERTIFICATE OF CORRECTION

PATENT NO. : 5,000,438

DATED : 03/19/91

INVENTOR(S) : Peter A. Sardano et al.

It is certified that error appears in the above--identified patent and that said Letters Patent is hereby corrected as shown below:

In Column 3, line 40, change "one" to --other--.
In claim 1, the penultimate line, change "one" to --other--.

Signed and Sealed this

Thirteenth Day of October, 1992

*Attest:*

DOUGLAS B. COMER

*Attesting Officer*

*Acting Commissioner of Patents and Trademarks*